US011840817B2

(12) United States Patent
Tian et al.

(10) Patent No.: US 11,840,817 B2
(45) Date of Patent: Dec. 12, 2023

(54) METHOD FOR CONSTRUCTING STEEL SHEET PILE COFFERDAM ON DEEP SAND GRAVEL OVERBURDEN LAYER

(71) Applicants: CHANGSHA UNIVERSITY OF SCIENCE AND TECHNOLOGY, Changsha (CN); RAILWAY NO. 5 BUREAU GROUP FIRST ENGINEERING CO. LTD., Changsha (CN)

(72) Inventors: Zhongchu Tian, Changsha (CN); Ye Dai, Changsha (CN); Yu Tang, Changsha (CN); Tao Peng, Changsha (CN); Binyang Ding, Changsha (CN); Pei Cong, Changsha (CN); Xuejun Peng, Changsha (CN); Yuman Luo, Changsha (CN); Yali Gu, Changsha (CN); Chaohua Luo, Changsha (CN); Hui Cao, Changsha (CN); Yunlong Liu, Changsha (CN); Tao Ling, Changsha (CN)

(73) Assignees: CHANGSHA UNIVERSITY OF SCIENCE AND TECHNOLOGY, Changsha (CN); RAILWAY NO 5 BUREAU GROUP FIRST ENGINEERING CO LTD, Changsha (CN)

( * ) Notice: Subject to any disclaimer, the term of this patent is extended or adjusted under 35 U.S.C. 154(b) by 0 days.

(21) Appl. No.: 17/846,847

(22) Filed: Jun. 22, 2022

(65) Prior Publication Data

US 2023/0002998 A1 Jan. 5, 2023

(30) Foreign Application Priority Data

Jul. 5, 2021 (CN) ..... 202110758621.6

(51) Int. Cl.
*E02D 19/04* (2006.01)

(52) U.S. Cl.
CPC ..... *E02D 19/04* (2013.01)

(58) Field of Classification Search
CPC .. E02D 19/04; E02D 5/04; E02D 5/14; E02D 25/00
See application file for complete search history.

(56) References Cited

U.S. PATENT DOCUMENTS 756,618 A * 4/1904 Friestedt ..... E02D 5/04 405/277
1,751,835 A * 3/1930 Monroe ..... E02D 19/04 405/222

(Continued)

FOREIGN PATENT DOCUMENTS

CN 106958253 A * 7/2017
CN 111350201 A 6/2020
WO WO-8502212 A1 * 11/1984

OTHER PUBLICATIONS

Translation CN 106958253 A; All; 2017 (Year: 2017).*

*Primary Examiner* — Benjamin F Fiorello
(74) *Attorney, Agent, or Firm* — Zhigang Ma

(57) ABSTRACT

A method for constructing a steel sheet pile cofferdam is provided, including: step S1, determining a construction area of the steel sheet pile cofferdam; step S2, piling steel casings, and welding guide frame brackets to the steel casings, the guide frame brackets are connected with a guide frame and limiting clamp plates; step S3, piling steel sheet piles by relying on the guide frame; step S4, pouring subsealing concrete at a bottom of the steel sheet pile cofferdam; step S5, arranging purlins and internal supports within the steel sheet pile cofferdam; step S6, perform a secondary subsealing at the bottom of the steel sheet pile cofferdam; step S7, pumping water within the steel sheet pile (Continued)

cofferdam through a pump and pouring to form a bearing platform on the subsealing concrete; step S8, removing the steel sheet pile cofferdam after the bearing platform is formed.

10 Claims, 5 Drawing Sheets

(56) References Cited

U.S. PATENT DOCUMENTS

| | | | | | |
|---|---|---|---|---|---|
| 2,179,429 | A * | 11/1939 | Schiavi | E02D 19/04 | 405/222 |
| 3,306,049 | A * | 2/1967 | Tachi | E02D 17/08 | 405/274 |
| 3,687,075 | A * | 8/1972 | Fritz | F42D 1/055 | 102/312 |
| 3,710,579 | A * | 1/1973 | Killmer | E02B 3/06 | 405/11 |
| 4,222,684 | A * | 9/1980 | Rosenstock | E02D 5/76 | 405/274 |
| 4,550,786 | A * | 11/1985 | Rosenstock | E02D 7/26 | 175/2 |
| 4,690,058 | A * | 9/1987 | Mohanty | F42D 1/00 | 299/13 |
| 5,407,304 | A * | 4/1995 | Glass | E02D 13/04 | 405/232 |
| 6,361,247 | B1 * | 3/2002 | Detiveaux | E02B 3/04 | 405/21 |
| 2002/0054791 | A1 * | 5/2002 | Nottingham | E02D 5/03 | 405/285 |
| 2010/0232878 | A1 * | 9/2010 | Feygin | E02D 19/04 | 405/14 |

* cited by examiner

METHOD FOR CONSTRUCTING STEEL SHEET PILE COFFERDAM ON DEEP SAND GRAVEL OVERBURDEN LAYER

TECHNICAL FIELD

The present disclosure relates to the field of bridge foundation construction technologies, and in particularly, to a method for constructing a steel sheet pile cofferdam on a deep sand gravel overburden layer.

DESCRIPTION OF RELATED ART

A steel sheet pile cofferdam is a most commonly used construction manner of a sheet pile cofferdam. The steel pile cofferdam has following advantages: bearing capacity is strong, a construction period is short, materials thereof is recyclable, and water retaining performance is good, which can meet requirements of structural safety, environment protection and the like, therefore, the steel pile cofferdam plays a vital role in the field of foundation construction, and is especially widely used in foundation construction of bridges.

However, in a process of bridge construction, a method for constructing the steel sheet pile cofferdam is mainly applied to a soft geological layer including powdered clay and sandy soil, and if the construction method is applied to a construction area with hard geological condition such as an over-sized solitary stone in a gravel layer, the process is difficult and construction progress thereof is slow; and during the process, steel sheet piles are very easy to be damaged and difficult to be piled at a designed elevation.

In view of this, it is required to provide a method for constructing a steel sheet pile cofferdam on a deep sand gravel overburden layer, to ensure that the steel sheet pile cofferdam is easy to be constructed in an area with an over-sized gravel.

SUMMARY

The first problem to be solved by the present disclosure is to provide a method for constructing a steel sheet pile cofferdam on a deep sand gravel overburden layer, which is simple in operation, safe and reliable in a construction process and fast in a construction progress.

To solve the above technical problems, a method for constructing a steel sheet pile cofferdam on a deep sand gravel overburden layer is provided according to the present disclosure, which includes:

step S1, determining a construction area of the steel sheet pile cofferdam;

step S2, piling a steel casing, and welding guide frame brackets to the steel casings, where the guide frame brackets are connected with a guide frame and limiting clamp plates;

step S3, piling steel sheet piles against the guide frame, including: during piling the steel sheet piles, when one of the steel sheet piles is unable to continue to be piled resulting from encountering an over-sized boulder, pulling out the one of the steel sheet piles, then drilling a blast hole in the over-sized boulder, feeding an explosive to a target depth in the blast hole through a conveyance sleeve, arranging a blasting device, detonating the explosive to break the over-sized boulder subjected to explosion energy of the explosive, and then continuing piling the steel sheet piles to a designed elevation until the steel sheet pile cofferdam is closed by the steel sheet piles;

step S4, pouring subsealing concrete at a bottom of the steel sheet pile cofferdam;

step S5, arranging multiple layers of purlins and multiple layers of internal supports within the steel sheet pile cofferdam;

step S6, perform a secondary subsealing at the bottom of the steel sheet pile cofferdam;

step S7, pumping water within the steel sheet pile cofferdam through a pump and then pouring to form a bearing platform on the subsealing concrete; and step S8, removing the steel sheet pile cofferdam after the bearing platform is formed.

In a preferred embodiment of the present disclosure, in the step S2, the guide frame brackets are arranged in at least two layers, and the guide frame is arranged in at least two layers.

More preferably, the step S3 may further include: during piling the steel sheet piles, when one of the steel sheet piles is unable to continue to be piled resulting from encountering the over-sized boulder, piling the steel sheet pile around the over-sized boulder through trials to determine a planar position, a depth and a size of the over-sized boulder, and estimating a dosage and an influence radius of the explosive.

Further, preferably, the step S3 may further include: after the explosive is fed, filling the blast hole with coarse sand, where a filled length is in a range from 0.8 meters (m) to 1.5 m.

In another preferred embodiment of the present disclosure, the step S3 may further include: drilling the over-sized boulder below the overburden layer through a geological driller cooperative with a steel sleeve tube.

In a preferred embodiment of the present disclosure, in the step S3, the conveyance sleeve is a polyvinylchloride (PVC) sleeve.

More specifically, in the step S4, the subsealing concrete is poured underwater by a tremie method.

In another preferred embodiment of the present disclosure, in the step S5, the plurality of layers of purlins are at least three layers, and the plurality of layers of internal supports are at least three layers.

More specifically, in the step S7, the pump is multiple in number, the multiple pumps are arranged at the bottom of the steel sheet pile cofferdam, and the multiple pumps are connected with pump drainage pipes.

In yet another preferred embodiment of the present disclosure, the multiple pumps are arranged at water inlets of the steel sheet pile cofferdam.

Based the above technical solutions, the method for constructing a steel sheet pile cofferdam on a deep sand gravel overburden layer may at least have the following beneficial effects.

Firstly, a hole is drilled on an over-sized boulder in the deep sand gravel overburden layer through a geological driller cooperative with the steel sleeve tube, an explosive is fed to the hole through the conveyance sleeve, and the explosive is detonated for achieving breaking and disintegration of the over-sized boulder, which can effectively avoid the influence of the over-sized boulder in a deep sand gravel overburden layer on the construction of the steel sheet pile cofferdam and avoid the piled steel sheet pile not reaching a designed elevation, the construction method is efficient and simple, which can greatly improves the construction efficiency of the steel sheet pile cofferdam and has good promotion value.

Secondly, after the over-sized boulder is encountered during the process of piling of the steel sheet piles, the steel sheet pile is struck around the over-sized boulder through trials to determine a planar position, a depth and a size of the over-sized boulder, and a dosage of the explosive is calculated by estimating an approximate volume of the over-sized boulder, and an influence radius is determined according to the dosage of the explosive, which avoids the impact of blasting on surrounding steel sheet piles already piled in.

Thirdly, after the hole drilling operation is completed, in order to ensure the breaking effect of the over-sized boulder, a conveyance sleeve is piled inside the steel sleeve tube, and then the steel sleeve tube is removed, and the explosive and a blasting device is fed to a target position through the conveyance sleeve.

Fourthly, by pouring the subsealing concrete at the bottom of the steel sheet pile cofferdam, it can effectively prevent the water from entering and form a water-free working environment inside the steel sheet pile cofferdam to ensure the safety of construction of the bearing platform, and after the purlins and the internal supports are arranged inside the steel sheet pile cofferdam, the bottom of the steel sheet pile cofferdam is sealed again to ensure bottom sealing effect.

Fifthly, a pump is arranged at the bottom of the steel sheet pile cofferdam, such that a pressure and permeable water at the bottom of the sealed bottom concrete are introduced to the outside of the steel sheet pile cofferdam to avoid a large area of water gushing inside the steel sheet pile cofferdam and to ensure water-free operating environment inside the steel sheet pile cofferdam and thereby to reduce difficulty of construction of the bearing platform and save construction cost.

Other advantages of the present disclosure and technical effects of the preferred embodiment will be further described in the specific embodiments below.

Figure 1:
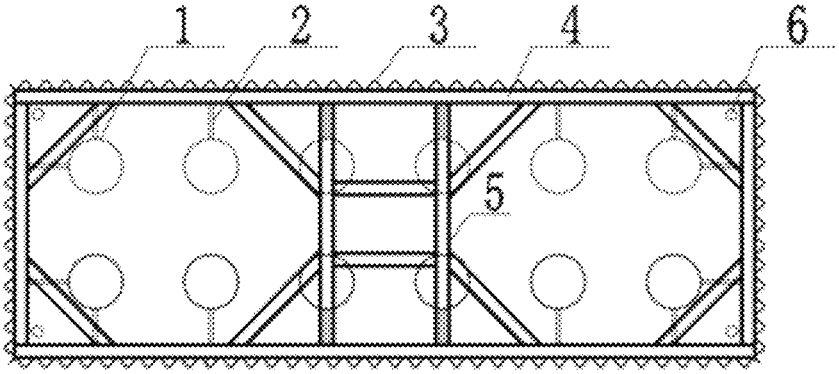
FIG. 1 illustrates a schematic structural view of a steel sheet pile cofferdam according to a specific embodiment of the present disclosure.

Reference numerals: 1: Steel casting; 2: Guide bracket; 3: Steel sheet pile; 4: purlin; 5: Internal support; 6: Pump drainage pipe; 7: Subsealing concrete; 8: Bearing platform; 9: Boulder; 10: Steel sleeve tube; 11: Conveyance sleeve; 12: Explosive.

DETAILED DESCRIPTION OF EMBODIMENT

Specific embodiments of the present disclosure are described in detail hereinafter with reference to accompanying drawings. It should be understood that the specific embodiments described herein are merely for the purpose of illustrating and explaining the present disclosure and are not intended to limit the present disclosure.

In the description of the present disclosure, it should be noted that, unless otherwise expressly specified and limited, terms such as "installing" and "connecting" are to be understood in a broad sense, for example, as a fixed connection, a removable connection, or a one-piece connection; it may be a direct connection or an indirect connection through an intermediary; it may be a connection within two components, or an interaction between two components. For the skilled in the art, specific meaning of the above terms of the present disclosure can be understood depending on specific conditions.

Figure 2:
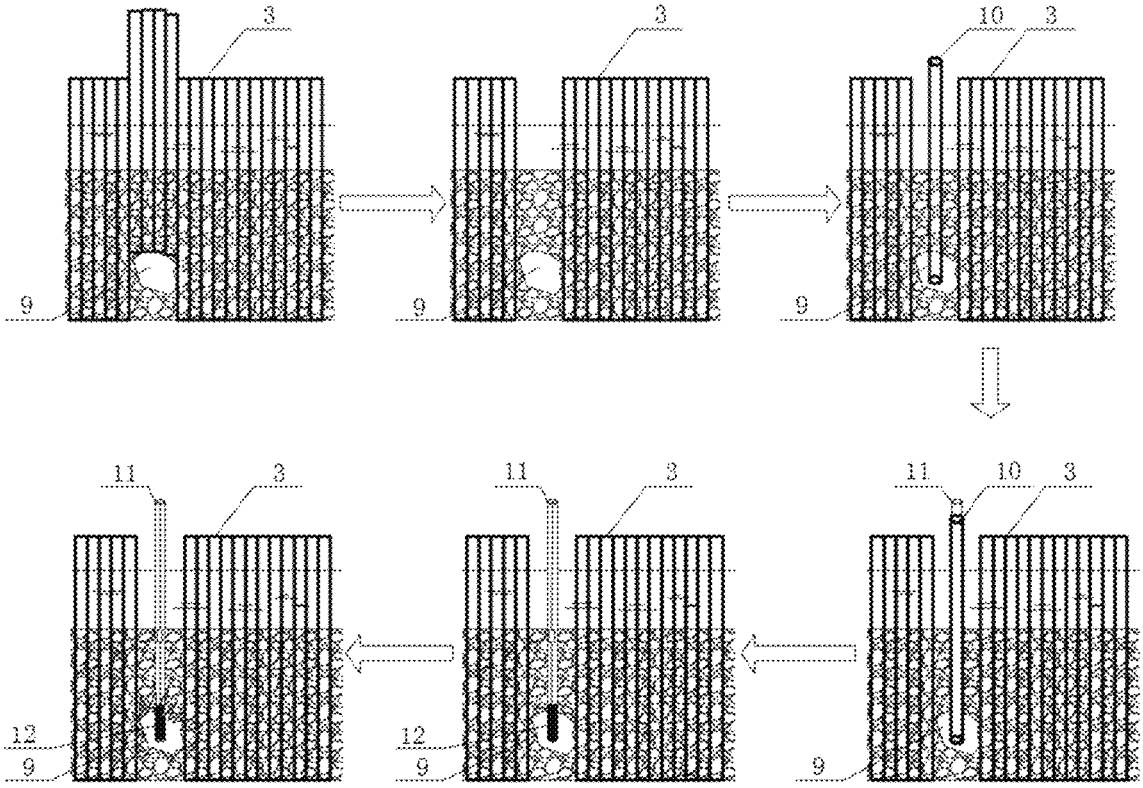
FIG. 2 illustrates a schematic view of drilling hole and detonating during construction of a steel sheet pile cofferdam according to the present disclosure.
Figure 3:
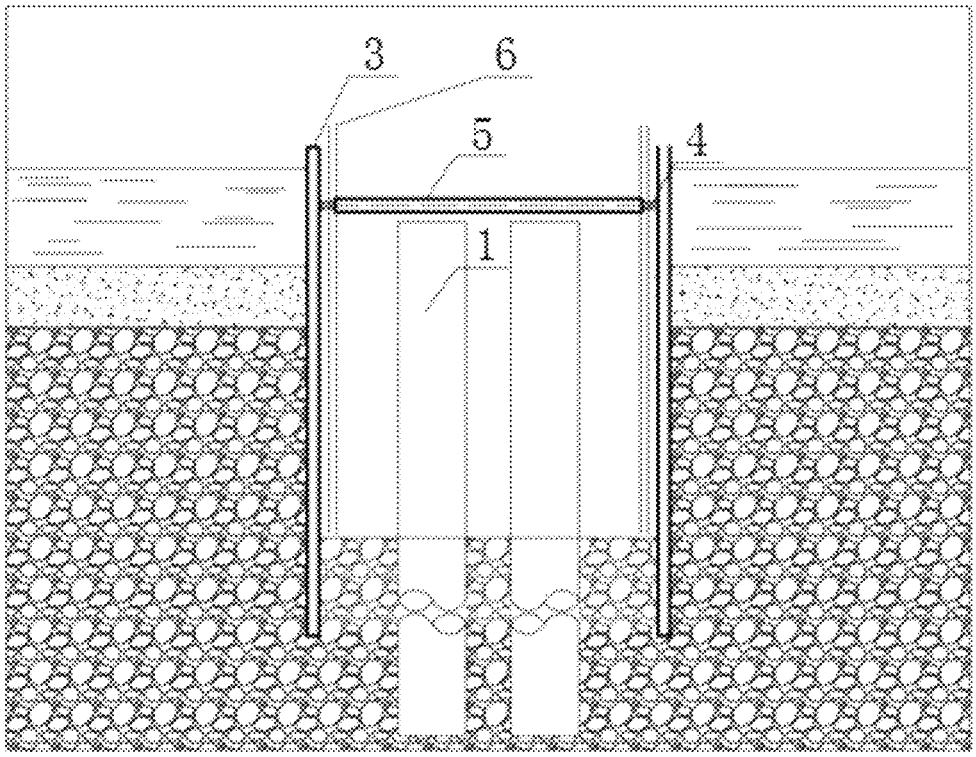
FIG. 3 illustrates a schematic view of installing a first layer of circular purlins and a first layer of internal supports during construction of a steel sheet pile cofferdam according to the present disclosure.
Figure 4:
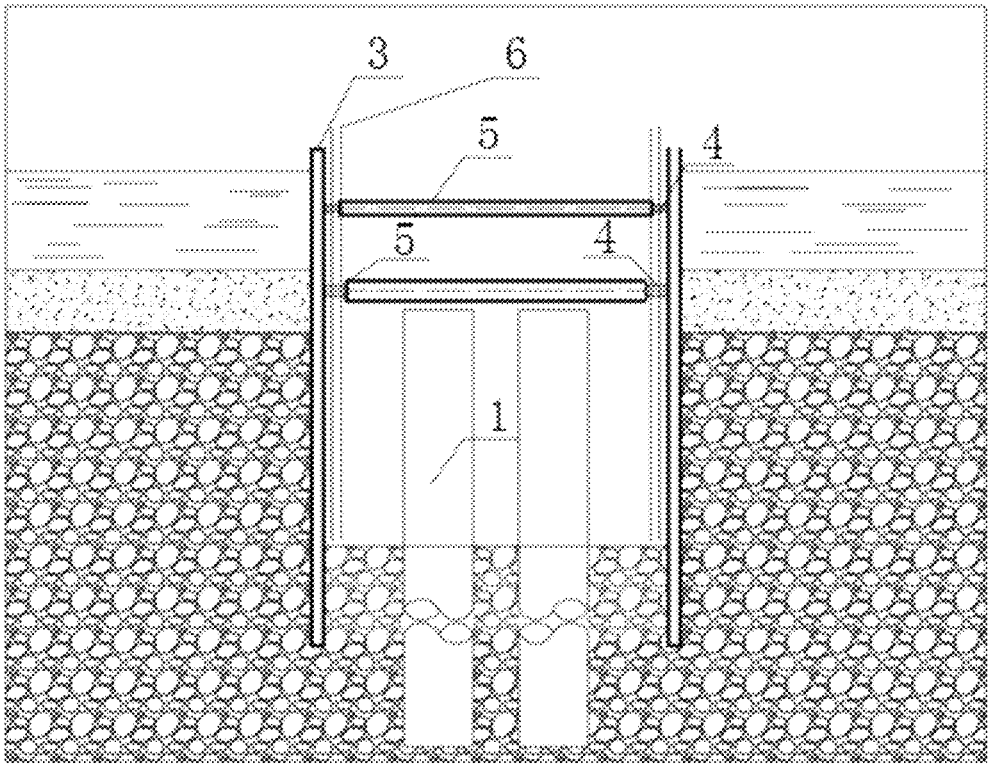
FIG. 4 illustrates a schematic view of installing a second layer of circular purlins and a second layer of internal supports during construction of a steel sheet pile cofferdam according to the present disclosure.
Figure 5:
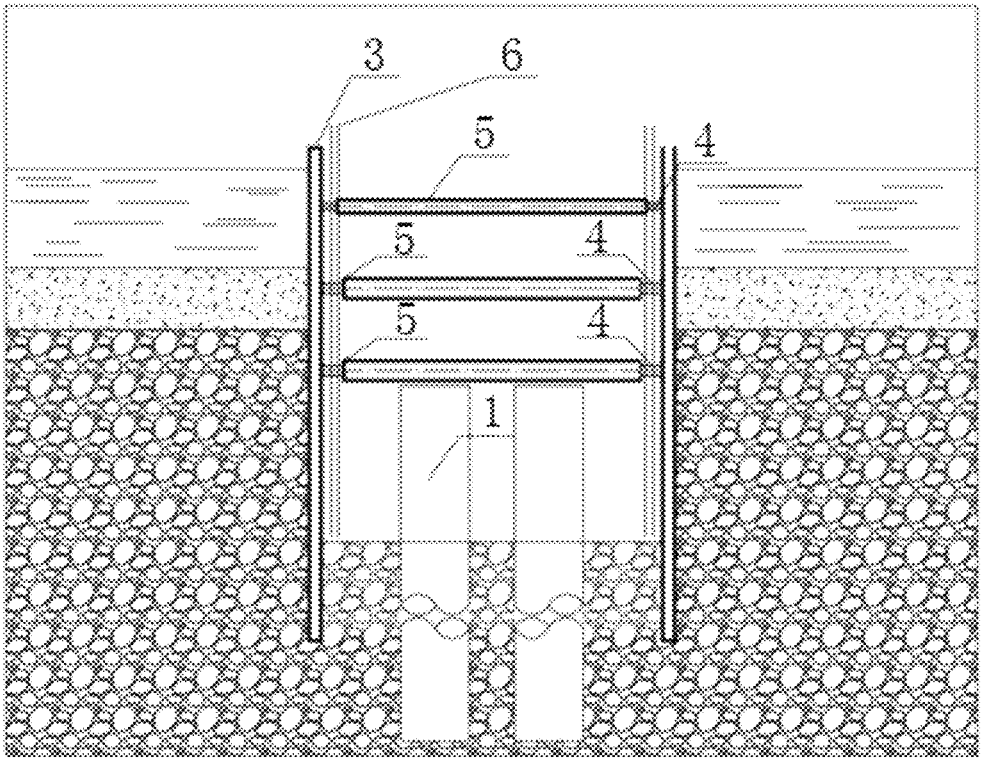
FIG. 5 illustrates a schematic view of installing a third layer of circular purlins and a third layer of internal supports during construction of a steel sheet pile cofferdam according to the present disclosure.
Figure 6:
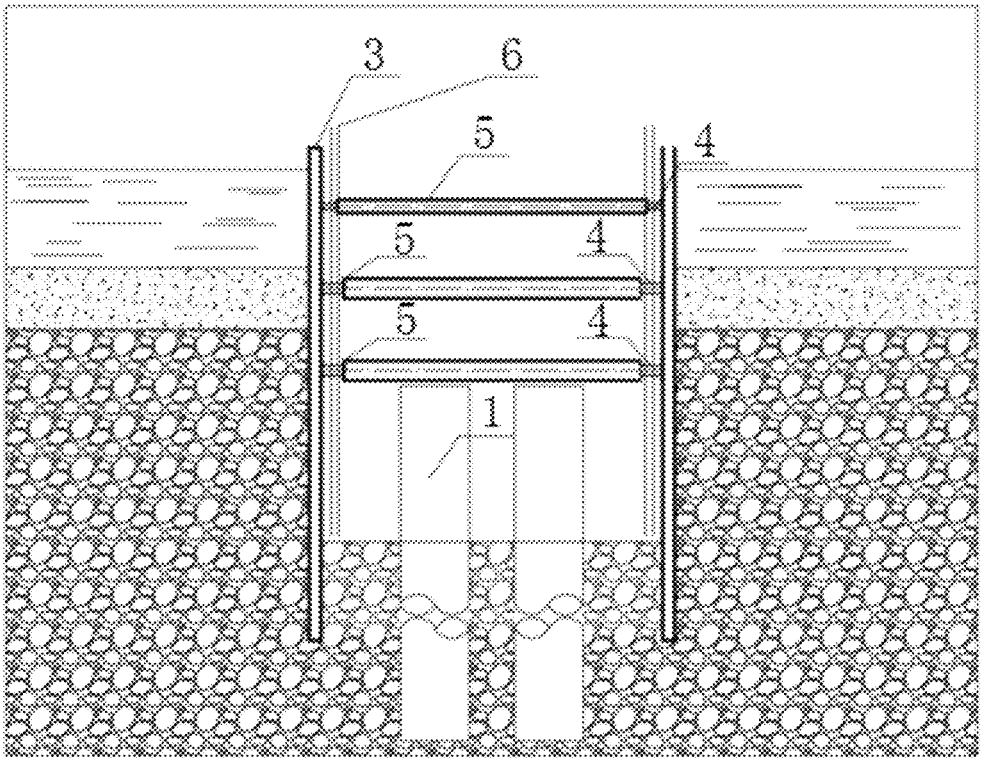
FIG. 6 illustrates a schematic view of pouring subsealing concrete during construction of a steel sheet pile cofferdam according to the present disclosure.
Figure 7:
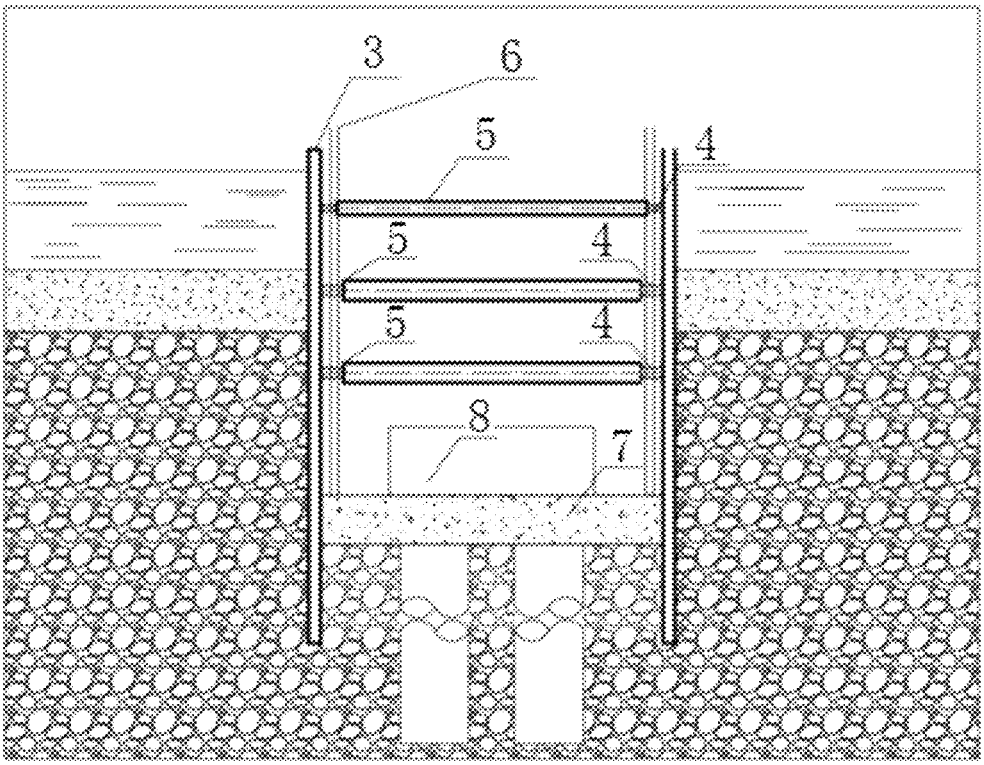
FIG. 7 illustrates a schematic view of pouring a bearing platform during construction of a steel sheet pile cofferdam according to the present disclosure.
Figure 8:
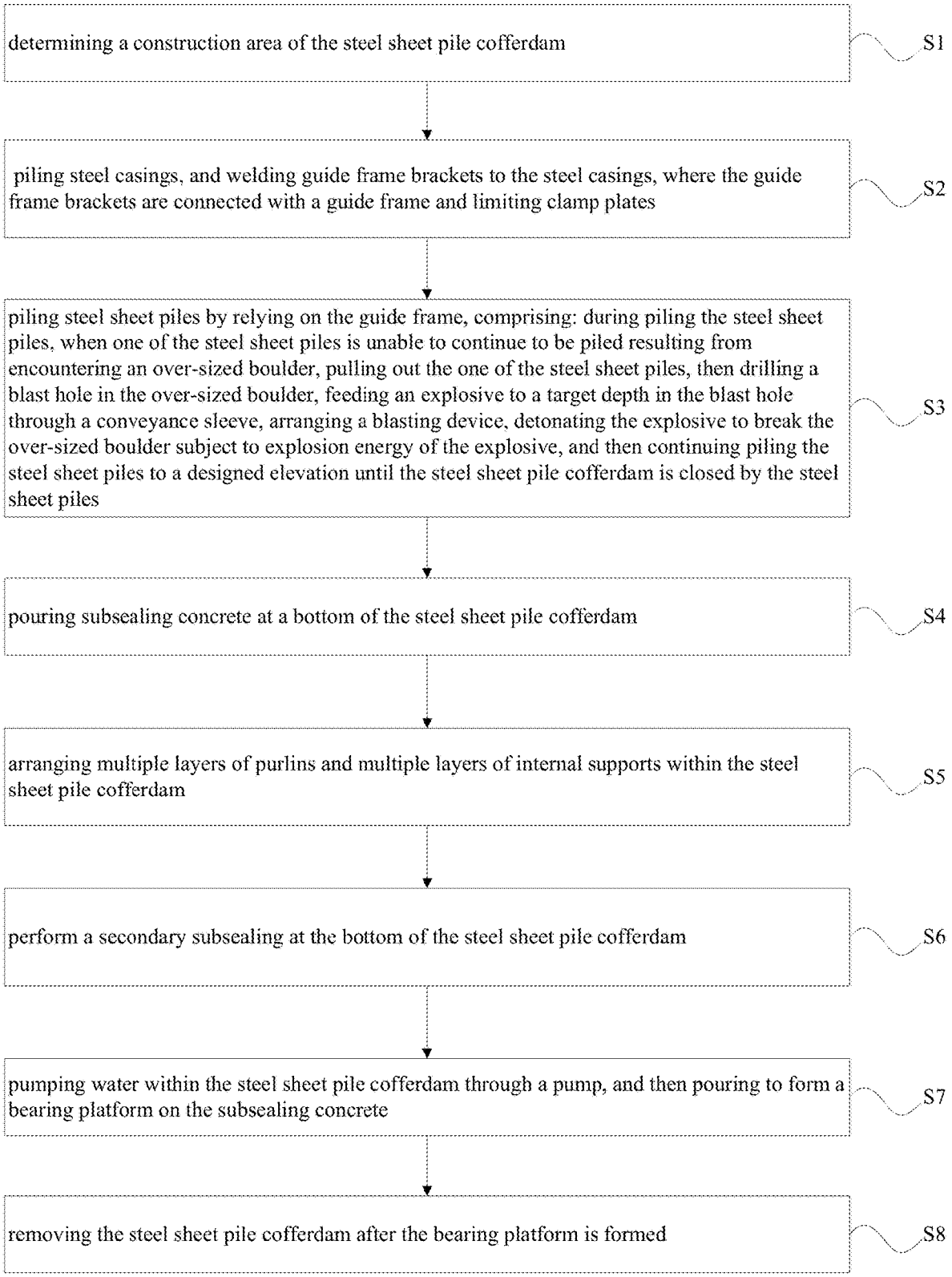
FIG. 8 illustrates a step view of a method for constructing a steel sheet pile cofferdam on a deep sand gravel overburden layer according to a specific embodiment of the present disclosure.

Referring to FIGS. 1 through 8, a method for constructing a steel sheet pile cofferdam on a deep sand gravel overburden layer includes steps from S1 to S8.

In step S1, a construction area of the steel sheet pile cofferdam is determined.

In step S2, a steel castings 1 are piled, guide frame brackets 2 are welded to the steel castings 1, and the guide frame brackets 2 are connected with a guide frame and limiting clamp plates.

In step S3, steel sheet piles 3 are piled by relying on the guide frame, including: during piling the steel sheet piles 3, when one of the steel sheet piles 3 is unable to continue to be piled resulting from encountering an over-sized boulder 9, the one of the steel sheet piles 3 is pulled out, a blast hole is drilled in the over-sized boulder, an explosive 12 is fed to a target depth in the blast hole through a conveyance sleeve 11, a blasting device is arranged, the explosive 12 is detonated to break the boulder 9 subject to explosion energy of the explosive 12, the steel sheet piles 3 are piled to a designed elevation until the steel sheet pile cofferdam is closed by the steel sheet piles 3.

In step S4, subsealing concrete 7 is poured at a bottom of the steel sheet pile cofferdam.

In step S5, multiple layers of purlins 4 and multiple layers of internal supports 5 are arranged within the steel sheet pile cofferdam.

In step S6, secondary subsealing is performed at the bottom of the steel sheet pile cofferdam.

In step S7, water within the steel sheet pile cofferdam is pumped through a pump and then a bearing platform 8 is poured and formed on the subsealing concrete 7.

In step S8, the steel sheet pile cofferdam is removed, after the bearing platform 8 is formed.

In a preferred embodiment of the present disclosure, in step S2, the guide frame brackets 2 may be arranged in at least two layers, and the guide frame may be arranged in at least two layers. According to an actual depth of the steel sheet pile cofferdam, the guide frame brackets 2 and the guide frame can also be set in multiple layers, for effectively increasing installation convenience of the steel sheet pile cofferdam.

In another preferred embodiment of the present disclosure, the step S3 may include: during piling the steel piles, when the steel sheet pile is unable to continue to be piled resulting from encountering the over-sized boulder, the steel sheet pile 3 is piled around the over-sized boulder 9 through trials to determine a planar position, a depth and a size of the over-sized boulder 9, and a dosage and an influence radius of the explosive 12 are estimated.

After the planar position, the depth and the size of boulder 9 are determined, the steel sheet piles 3 in an area of the boulder 9 are required to be pulled out. After the steel sheet piles 3 are pulled out, a drilling position of a geological driller is determined using a fixing device, and the geological driller cooperates with a steel sleeve tube 10 to drill the over-sized boulder 9 to form the blast hole. After the boulder 9 is drilled, a gravel or sundries around the blast hole is cleaned up to prevent the gravel or the sundries from falling into the blast hole to fill the blast hole. Next, the blast hole will be strictly inspected by a blasting engineer and technician. If the blast hole is found to be inconsistent with a designed size, a corresponding measure is taken to correct the blast hole in time to ensure that the blast hole can be adapted for performing corresponding operations. Then, the conveyance sleeve 11 is piled into the steel sleeve tube 10 to reach the blast hole, and the explosive 12 is delivered into the drilled blast hole through the conveyance sleeve 11.

It should be noted herein that, the over-sized is not limited specifically. During piling the steel sheet piles 3, when the steel sheet pile 3 is prevented by a boulder with a specific size from continuing to travel downwards, so that the steel sheet piles 3 cannot reach the designed elevation, the boulder 9 with this specific size can be understood as the over-sized boulder 9.

Preferably, in step S3, after the explosive 12 is fed, coarse sand is used to fill the blast hole, and a filled length is in a range from 0.8 meters (m) to 1.5 m.

Preferably, the filling length is 1 m. During the construction, it is not allowed to increase the dosage of the explosive 12 or change the filled length at will. When filling the hole, the compactness of filled materials should be ensured to prevent filling from hanging up, and a nonel tube should be not pulled too tightly, so as to avoid corresponding damage. Further, the corresponding blasting device is arranged to explode the explosive 12 to thereby break the over-sized boulder 9.

Further, preferably, the step S3 may further include: drill the boulder 9 below the overburden layer through the geological driller cooperative with the steel sleeve tube 10.

In still another preferred embodiment of the present disclosure, in step S3, the conveyance sleeve 11 may be a polyvinylchloride (PVC) sleeve.

It should be noted that, in the present disclosure, step S3 can be performed repeatedly. In the construction process of the steel sheet pile cofferdam, whenever an over-sized boulder 9 is encountered, the step S3 can be repeated, such that the over-sized boulder 9 can be detonated to meet the requirements of the piling of the steel sheet piles 3.

In a specific embodiment of the present disclosure, in the step S4, the subsealing concrete 7 is poured underwater by a tremie method.

More specifically, the multiple layers of purlins 4 are at least three layers, and the multiple layers of internal supports are at least three layers.

In step S6 of the present disclosure, before performing the secondary sealing, an upper surface of the poured subsealing concrete 7 in step S4 is required to be cleaned. The materials of subsealing concrete in steps S4 and S6 are the same.

In a specific embodiment of the present disclosure, in the step S7, the pump is multiple in number, the multiple pumps are arranged at the bottom of the steel sheet pile cofferdam, and the multiple pumps are connected with pump drainage pipes 6.

Further, specifically, the at least two pumps are arranged at water inlets of the steel sheet pile cofferdam.

In step S8 of the present disclosure, after the bearing platform 8 is poured within the steel sheet pile cofferdam, sand or water is filled into the steel sheet pile cofferdam to ensure the pressures inside and outside the steel sheet pile cofferdam are stable, and then the steel sheet piles 3 are pulled out in turn.

The steel sheet pile cofferdam formed according to the method for constructing the steel sheet pile cofferdam on a deep sand gravel overburden layer of the present disclosure includes multiple steel castings 1, each of the steel castings 1 is connected with two layers of guide frame brackets 2. Further, each of the guide frame brackets 2 is connected with a guide frame and limiting clamp plates. Several steel sheet piles 3 are piled into a gravel layer by relying on the guide frame, three layers of purlins 4 and three layers of internal supports 5 are arranged in the steel sheet pile cofferdam, and the steel sheet pile cofferdam is rectangular. Four corners of the steel sheet pile cofferdam are each provided with a pump, and each of the pumps connected with a pump drainage pipe 6. The bottom of the steel sheet pile cofferdam is poured with subsealing concrete 7, and the upper surface of the subsealing concrete 7 is poured with a bearing platform 8. With the gradual downward construction of the purlins 4 and the internal supports 5, the steel casings 1 are cut off layer by layer. After the construction, the steel sheet pile cofferdam, the purlins 4, the internal supports 5 and the pumps will also be removed.

The construction method of the present disclosure is explained in detail hereinafter according to a specific embodiment as follows.

The Zhenluo Yellow River Bridge is located in Zhenluo Town, and spans Binhe Avenue, Huanghe River and Binhe South Road from north to south in turn. A starting point pile number of the Zhenluo Yellow River Bridge is LK5+679.5, an ending point pile number of the Zhenluo Yellow River Bridge is LK6+968.5, and a total length of the Zhenluo Yellow River Bridge is 1289 m. The Zhenluo Yellow River Bridge is divided into five sections, including: a north bank approach bridge of (3×40) m, a north bank bridge of (2×40+75+40) m, a main bridge of (55+6×90+55) m, a south bank bridge of (2×40+75+40) m, and a south bank approach bridge of (3×40) m.

The main bridge of Zhenluo Yellow River Bridge crosses surface runoff of the Yellow River. A water surface width of the main bridge is about 540 m. A maximum value of a water depth thereof is about 4.5 m, and the water depth has a change range from 1.0 m to 1.5 m. Under a current river condition, a design peak flow corresponding to a bridge section P=0.33% is 6350 $m^3$/second (s), and a corresponding flood level is 1206.99 m; a design peak flow corresponding to a bridge section P=5% is 5620 $m^3$/s, and a corresponding flood level is 1206.69 m; a design peak flow corresponding to a bridge section P=10% is 5530 $m^3$/s, and a corresponding flood level of 1206.66 m. Bridge piers 8# to 13# of the main bridge of Zhenhuang River Bridge is located in the Yellow River. According to a design specification, a highest flood level is 1206.99 m, and a height difference between a top surface of the bearing platform and the highest flood level is in a range from 4.539 m to 7.078 m. Geological conditions at the bridge piers are complex, and a stratum is divided from top to bottom into following layers: a silty clay layer of a depth from 0.8 m to 2.5 m with a fine sand layer of a depth from 1.4 m to 1.5 m, and a gravel layer of a depth from 4.6 m to 22.9 m with a silty clay layer of a depth from 0.8 m to 2.5 m, and a fine sand layer of a depth from 1.4 m to 1.5 m. The gravel layer is bluish gray, and is mainly composed of sandstone and filled with sandy and cohesive soil. The gravel layer is saturated and dense with a gravel content of about 60%. A gravel in the gravel layer is in a sub-circular shape with a size from 1 centimeters (cm) to 40 cm. The bearing platform of each of the bridge piers 8# to 13# of the main bridge are buried deeply, and the gravel layer is thick, and an over-sized boulder 9 may exist.

Construction steps of the steel sheet pile cofferdam according to an embodiment of the present disclosure are as follows.

1. A drilling platform of each of the bridge piers 8# to 13# is removed, steel casings 1 are piled within a construction area of the steel sheet pile cofferdam to determine a construction position. Two layers of guide frame brackets are welded on the steel casing 1, and two layers of guide frames and limit clamp plates are installed, and steel sheet piles 3 are piled by relying on the guide frames.

The steel sheet piles 3 of 15 m are piled in turn along the two layers of guide frames. Because the gravel layer is thick and there is an over-sized boulder 9 in the gravel layer, it is difficult to pile the steel sheet piles 3 to a designed elevation, it is required to pull out the blocked steel sheet pile 3 and drill a blast hole and perform a blasting operation in the blast hole at the original position, to break and disintegrate the over-sized boulder 9 in the thick gravel layer.

3. The blocked steel sheet pile 3 at the original position is piled through trials, to determine a planar position and a depth of the over-sized boulder 9, and estimate a size of the over-sized boulder 9 and determine a dosage of an explosive according to the determined size of the boulder 9, and pull out the steel sheet pile 3 around a blasting influence area that has been successfully piled according to the blasting influence area.

4. A geological driller is used to drill the over-sized boulder 9 to take the blast hole. It should be noted that, the geological driller is used to cooperate with the steel sleeve tube 10, which can avoid collapse phenomenon of the blast hole and ensure accurate feeding of explosives to a target location.

5. After drilling and taking the blast hole, gravels or sundries around the blast hole are cleaned up to prevent the gravels or sundries from falling into the blast hole and blocking the blast hole. A blasting engineer and technician shall strictly inspect the blast hole. If the blast hole is found to be inconsistent with a design, A The blasting engineer and technician shall promptly inform an on-site engineer and technician to take corresponding measures to correct the blast hole, so as to ensure that the blast hole is adapted for corresponding operations. Then, a conveyance sleeve 11 reaches the blast hole along the steel sleeve tube 10, and an explosive is conveyed into the drilled blast hole through the conveyance sleeve 11.

6. Coarse sand is used to fill the blast hole, and a corresponding filling length is 1 m according to past experience. During site construction, it is not allowed to increase the dosage of the explosive 12 or change the filling length at will. When filling the blast hole, the compactness of filling materials should be ensured to prevent filling from hanging up, and a nonel tube should be not pulled too tightly, so as to avoid corresponding damage. Further, the corresponding blasting device is arranged to explode the explosive 12 to thereby break the over-sized boulder 9.

7. The steel sheet pile 3 is re-piled at the position where it is blocked, and blasting effect is examined. After successfully piling into the designed elevation, the pulled steel sheet pile 3 is re-piled into the original place again, and then remaining steel sheet piles 3 are piled to the design elevation in turn until the cofferdam is closed by the steel sheet piles 3.

8. The steel sheet pile cofferdam is excavated with water, and a long arm excavator is used to excavate the cofferdam and clear foundation of the cofferdam, and the internal and external water levels are kept consistent.

9. Subsealing concrete is poured to the bottom of the steel sheet pile cofferdam 7. The subsealing concrete is underwater self-leveling concrete, preferably C30 type concrete.

10. Water in the steel sheet pile cofferdam is pumped to 50 cm below a first layer of purlins 4. After a steel casing 1 that conflicts with the first layer of purlins 4 and a first layer of internal supports 5 are cut off, the first layer of purlins 4 and the first layer of internal supports 5 are installed. Then, water in the steel sheet pile cofferdam is pumped to 50 cm below a second layer of purlins 4. After a steel casing 1 that conflicts with the second layer of purlins 4 and a second layer of internal supports 5 are cut off, the second layer of purlins 4 and the second layer of internal supports 5 are installed. Further, water in the steel sheet pile cofferdam is pumped to 50 cm below a third layer of purlins 4. After a steel casing 1 that conflicts with the third layer of purlins 4 and a third layer of internal supports 5 are cut off, the third layer of purlins 4 and the third layer of internal supports 5 are installed.

11. Water in the steel sheet pile cofferdam is pumped to a bottom of a foundation pit, and a watertight adhesive joints are arranged at a lower of the steel sheet pile cofferdam. After the arrangement, a bottom of each of the steel sheet piles 3 is cleaned up, and three pumps are placed at water inlets of the steel sheet pile cofferdam to ensure a waterless working environment is formed in the steel sheet pile cofferdam.

12. A template of a bearing platform 8 is installed, steel bars and embedded parts are arranged, and concrete pouring is performed. After the bearing platform is formed, the purlins 4 and the internal supports 5 are removed in turn. It should be noted that, sand and gravels should be filled back synchronously during the removing process, and the pumping water operation is stopped to prevent structural damage caused by imbalance of internal and external forces caused by the removing of the surrounding purlins 4 and the internal supports 5.

13. The steel sheet piles 3 downstream are removed firstly, then the steel sheet piles 3 on both sides are removed, and the steel sheet piles 3 facing a water surface are removed, thereby the construction of the steel sheet pile cofferdam is finished.

It can be seen from the above description that, with the method for constructing a steel sheet pile cofferdam on a deep sand gravel overburden layer of the present disclosure, when an over-sized boulder 9 is encountered during piling the steel sheet piles 3, concrete data of the over-sized boulder 9 is determined by the steel sheet pile 3, and the over-sized boulder 9 is changed into broke stones with a small size by blasting, and thereby the requirement of the piling steel sheet piles 3 is met. The method for constructing the steel sheet pile cofferdam on the deep sand gravel overburden layer according to the present disclosure is simple to operate, efficient and convenient, can effectively improve construction efficiency of the steel sheet pile cofferdam, has good economic and social benefits, and has good popularization value.

The above describes in detail the preferred embodiments of the present disclosure with reference to the accompanying drawings, however, the present disclosure is not limited to the specific details in the above embodiment, and a variety of simple variants of the technical solutions of the present disclosure can be made within the technical conception of the present disclosure, and all of the simple variants fall within the scope of protection of the present disclosure.

It is also to be noted that various specific technical features described in the above specific embodiments can be combined in any suitable manner without contradicting each other, various possible combination manners will not be described separately in the present disclosure for avoiding unnecessary repetition.

Furthermore, any combination between the various different embodiments of the present disclosure may also be made, and as long as the combination does not contradict the idea of the present disclosure, it shall also be considered as disclosed in the present disclosure.

What is claimed is:

1. A method for constructing a steel sheet pile cofferdam on a sand gravel overburden layer, the sand gravel overburden layer comprising an over-sized boulder, and the method comprising:

step S1, determining a construction area of the steel sheet pile cofferdam;

step S2, piling steel casings in the construction area, and welding guide frame brackets to the steel casings, wherein the guide frame brackets are connected with a guide frame;

step S3, piling steel sheet piles in the sand gravel overburden layer by relying on the guide frame, comprising: during piling the steel sheet piles, when one of the steel sheet piles is unable to continue to be piled resulting from encountering the over-sized boulder, pulling out the one of the steel sheet piles, then drilling a blast hole in the over-sized boulder, feeding an explosive to a target depth in the blast hole through a conveyance sleeve, arranging a blasting device, detonating the explosive to break the over-sized boulder subject to explosion energy of the explosive, and then continuing piling the steel sheet piles to a designed elevation until the steel sheet pile cofferdam is closed by the steel sheet piles;

step S4, pouring subsealing concrete at a bottom of the steel sheet pile cofferdam;

step S5, arranging a plurality of layers of purlins and a plurality of layers of internal supports within the steel sheet pile cofferdam;

step S6, perform a secondary subsealing at the bottom of the steel sheet pile cofferdam;

step S7, pumping water within the steel sheet pile cofferdam through a pump, and then pouring to form a bearing platform on the subsealing concrete; and step S8, removing the steel sheet pile cofferdam after the bearing platform is formed:

wherein the step S3 further comprises:

estimating an influence radius of the explosive; and before the detonating the explosive, pulling out at least one steel sheet pile, which is piled in the sand gravel overburden layer before the one of the steel sheet piles and in a range of the influence radius.

2. The method according to claim 1, wherein the step S3 further comprises: after the detonating the explosive, re-piling the at least one steel sheet pile in the sand gravel overburden layer.

3. The method according to claim 1, wherein the step S3 further comprises: during piling the steel sheet piles, when one of the steel sheet piles is unable to continue to be piled resulting from encountering the over-sized boulder, piling the one of the steel sheet piles around the over-sized boulder through trials to determine a planar position, a depth and a size of the over-sized boulder, and estimating a dosage.

4. The method according to claim 3, wherein the step S3 further comprises: after the explosive is fed, filling the blast hole with coarse sand, wherein a filled length is in a range from 0.8 meters (m) to 1.5 m.

5. The method according to claim 1, wherein the step S3 comprises: drilling the over-sized boulder below the overburden layer through a geological driller cooperative with a steel sleeve tube.

6. The method according to claim 1, wherein in the step S3, the conveyance sleeve is a polyvinylchloride (PVC) sleeve.

7. The method according to claim 1, wherein in the step S4, the subsealing concrete is poured underwater by a tremie method.

8. The method according to claim 1, wherein in the step S5, the plurality of layers of purlins are at least three layers, and the plurality layers of internal supports are at least three layers.

9. The method according to claim 1, wherein in the step S7, the pump is multiple in number, the multiple pumps are arranged at the bottom of the steel sheet pile cofferdam, and the multiple pumps are connected with pump drainage pipes.

10. A method for constructing a steel sheet pile cofferdam on a sand gravel overburden layer, the sand gravel overburden layer comprising an over-sized boulder, and the method comprising:

step S1, determining a construction area of the steel sheet pile cofferdam;

step S2, piling steel casings in the construction area, and welding guide frame brackets to the steel casings, wherein the guide frame brackets are connected with a guide frame;

step S3, piling steel sheet piles in the sand gravel overburden layer by relying on the guide frame, comprising: during piling the steel sheet piles, when one of the steel sheet piles is unable to continue to be piled resulting from encountering the over-sized boulder:

pulling out the one of the steel sheet piles;

estimating a size of the over-sized boulder by piling the one of the steel sheet piles around the over-sized boulder through trials, determining a dosage of an explosive according to the size of the over-sized boulder, and determining an influence radius of the explosive according to the dosage of the explosive;

pulling out at least one steel sheet pile, which is piled in the sand gravel overburden layer before the one of the steel sheet piles and around the influence radius; and drilling a blast hole in the over-sized boulder, feeding the explosive to a target depth in the blast hole through a conveyance sleeve, arranging a blasting device, detonating the explosive to break the over-sized boulder subject to explosion energy of the explosive, and then continuing piling the steel sheet piles to a designed elevation until the steel sheet pile cofferdam is closed by the steel sheet piles;

step S4, pouring subsealing concrete at a bottom of the steel sheet pile cofferdam;

step S5, arranging a plurality of layers of purlins and a plurality of layers of internal supports within the steel sheet pile cofferdam;

step S6, perform a secondary subsealing at the bottom of the steel sheet pile cofferdam;

step S7, pumping water within the steel sheet pile cofferdam through a pump, and then pouring to form a bearing platform on the subsealing concrete; and step S8, removing the steel sheet pile cofferdam after the bearing platform is formed.

* * * * *